US007219821B2

(12) United States Patent
Weal et al.

(10) Patent No.: US 7,219,821 B2
(45) Date of Patent: May 22, 2007

(54) BOOTYHOOK SPORTING GOODS HANGER

(76) Inventors: Matthew D. Weal, 1011 Red Oak Pl., Camarillo, CA (US) 93010; Paul W. Weal, 1271 Skeel Dr., Camarillo, CA (US) 93010

( * ) Notice: Subject to any disclaimer, the term of this patent is extended or adjusted under 35 U.S.C. 154(b) by 32 days.

(21) Appl. No.: 11/064,251

(22) Filed: Feb. 22, 2005

(65) Prior Publication Data

US 2005/0189383 A1 Sep. 1, 2005

Related U.S. Application Data

(60) Provisional application No. 60/546,430, filed on Feb. 21, 2004.

(51) Int. Cl.
*A41D 27/22* (2006.01)

(52) U.S. Cl. ..... 223/85

(58) Field of Classification Search ..... 223/85, 223/88, 92, 95, 97, DIG. 1
See application file for complete search history.

(56) References Cited

U.S. PATENT DOCUMENTS

| | | | | |
|---|---|---|---|---|
| D229,001 | S | 11/1973 | Wahl | |
| 3,815,797 | A * | 6/1974 | Schamber | 223/88 |
| D231,965 | S | 7/1974 | Gutestam | |
| D246,083 | S | 10/1977 | Auersperg | |
| D251,891 | S | 5/1979 | Solomon | |
| D296,046 | S | 6/1988 | Marshall | |
| 4,978,043 | A | 12/1990 | Uke | |
| 5,056,693 | A * | 10/1991 | DeBoe | 223/88 |
| 5,163,590 | A * | 11/1992 | Lawler et al. | 223/88 |
| 5,480,075 | A * | 1/1996 | Robinson | 223/88 |
| 6,216,887 | B1 * | 4/2001 | Soo | 211/85.7 |
| 6,758,378 | B2 * | 7/2004 | Carmichael | 223/85 |

* cited by examiner

*Primary Examiner*—Gary Welch
*Assistant Examiner*—Andrew W. Sutton
(74) *Attorney, Agent, or Firm*—Fulwider Patton LLP

(57) ABSTRACT

A hanger that is formed to accept the holding of a pair of wetsuit booties inverted position and angled to optimize storage space and liquid drainage from the inverted footwear.

5 Claims, 2 Drawing Sheets

BOOTYHOOK SPORTING GOODS HANGER

CROSS-REFERENCES TO RELATED APPLICATIONS

This is a non-provisional application claiming priority to provisional application No. 60/546,430 entitled Bootyhook Sporting Goods Hanger filed on Feb. 21, 2004, which is hereby incorporated by reference in its entirety.

FIELD OF THE INVENTION

The present invention relates to hangers for drying wetsuit booties such as surfing and scuba diving booties.

BACKGROUND OF THE INVENTION

Description of the Prior Art

For the purposes of comfort and protection surfers and scuba divers often wear latex booties which may be relatively tight fitting over the wears foot and ankle to insulate against the cold. In the case of enthusiasts a surfer or diver might participate in his or her water sport or work several times per week or even multiple occasions during a twenty-four hour period.

When the bootie is removed after a sporting event, it is often stored upright with moisture in the interior thereof resulting in a rather moist environment which may be to slow drying leading to the development of a musty odor or even mold or mildew. In recognition of this long-standing problem, numerous different hanger and suspension devices have been proposed in effort to having the wet booties in an inverted position.

It has been proposed to provide hangers including upstanding posts of wire or the like over which the ankle of a shoe or boot may be inserted to hang the boot in an inverted position. Devices of this type are shown in U.S. Pat. No. Des. 229,001 to Wahl and U.S. Pat. No. 231,965 to Gutestam. These hangers suffer the shortcoming that the toe part of the boot then often sag downwardly and, in the case of the flexible lycra booty will typically allow residual salt or fresh water to pool in the toe of the boot thus delaying the drying process and contributing to the tendency to create a musty or moldy climate.

In recognition of this shortcoming, it has been proposed to provide a hanger with upstanding posts which are formed at their upper extremities with horizontally projecting arms to be received in the shoe part of the boot. Again, such devices fail to solve the problem in that the boot may still sag over the relatively thin post and arm and orient itself in a position with the toe part of the boot inclined downwardly resulting in the collection of water therein.

Other hangers have been proposed which are of generally planar construction are formed with a stem, hook and oppositely disposed upstanding posts. Devices of this type are shown in U.S. Pat. No. Des. 246,083 to Auersperg and U.S. Pat. No. Des. 251,891 to Solomon. These devices, while offering benefit over narrow wire posts, still suffer the shortcoming that the toe part of the booty will tend to sag downwardly and act as a water collector.

Other proposals have been made to provide footwear hangers having flanged construction with upstanding posts. A device of this type is shown in U.S. Pat. No. Des. 296,046 to Marshall.

Still further efforts have led to the proposal of a wetsuit hanger which includes a stem, carrying a cross bar having a pair of proximal upstanding posts for receiving gloves and a pair of distal fingers spaced laterally outwardly therefrom and projecting upwardly and then turning inwardly an angle of about 30° to the vertical for receipt of the ankle and foot portion of a booty. A device of this type is shown in U.S. Pat. No. 4,978,043 to Uke. Such devices suffer the shortcoming that the obtuse angle in the upstanding fingers, without restriction on downwardly and inwardly travel of the ankle portion of the booty, allows the booty itself to freely slide downwardly over the finger such that the top extremity of the finger may be received in the toe of the boot with the ankle portion of the booty disposed more or less horizontally thereby ending up with a poor drainage situation and often times collecting drain moisture in the ankle portion of the boot.

SUMMARY OF THE INVENTION

The present invention is characterized by a boot hanger having a stem with flanking boot posts angling upwardly and outwardly at substantially 45° to the horizontal and then turning inwardly an angling upwardly to form foot sections which may have upwardly and outwardly facing support surfaces angling upwardly and inwardly at a angle of about 45° to the horizontal and against which the inner sole of the boot might nest.

Other features and advantages of the invention will become apparent from the following detailed description, taken in conjunction with the accompanying drawings which illustrate, by way of example, the features of the invention.

DETAILED DESCRIPTION OF THE INVENTION

Figure 1:
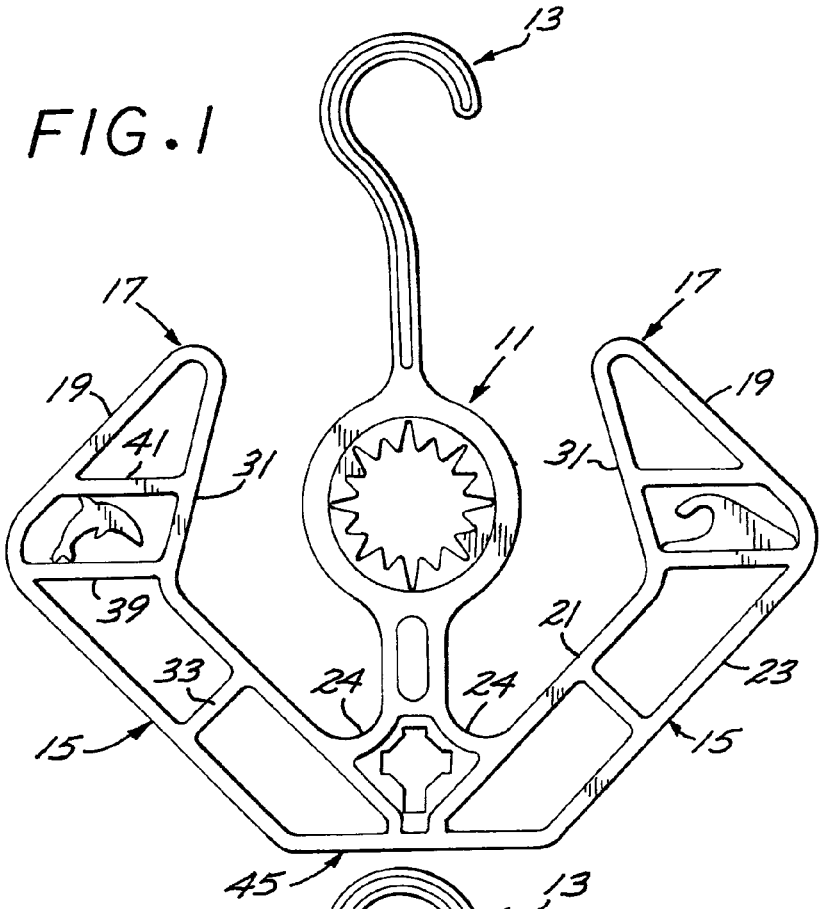
FIG. 1 is a front view of a wetsuit booty hanger embodiment of the present invention.
Figure 2:
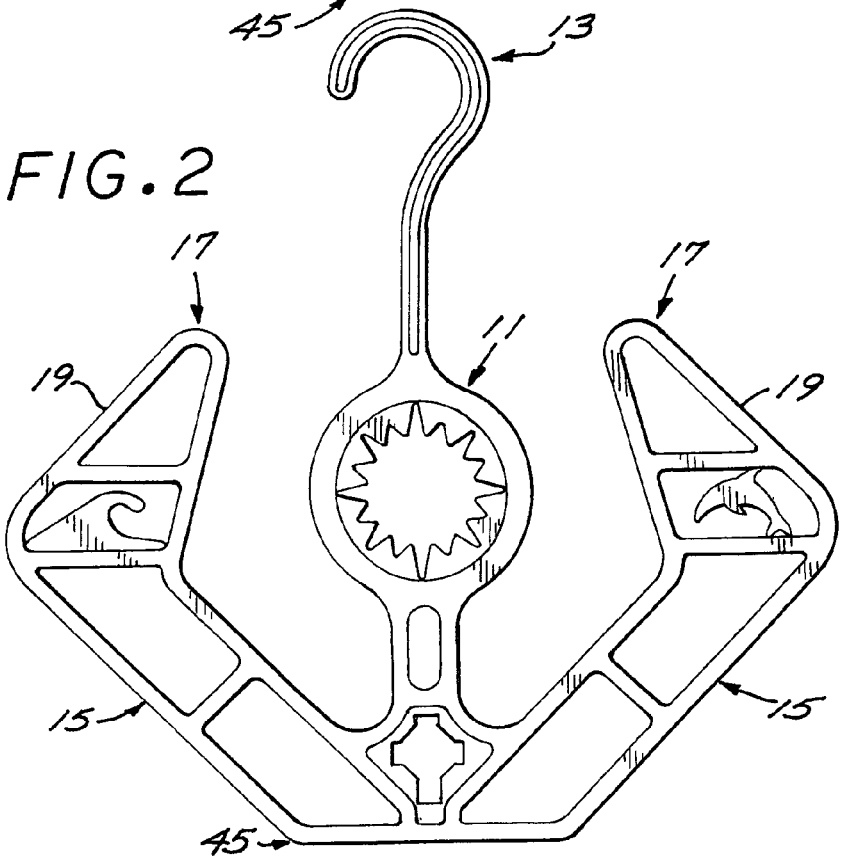
FIG. 2 is a back view of the hanger shown in FIG. 1.

Referring to FIGS. 1 and 2, the hanger of the present invention includes, generally, an upstanding stem formed centrally with a circular ring 11 which has a central portion into which may be placed a label, indicia and the like. The stem is formed at the upper extremity with a suspension hook 13.

Formed on the opposite side of the stem at the bottom are a pair of upwardly and outwardly angled legs defining posts which include a respective ankle support sections, generally designated 15, which angle upwardly and outwardly at substantially 45° to the vertical and respective triangular foot support sections 17 having respective rails 19 along the upper edges defining upwardly and outwardly angled support surfaces disposed at substantially 45° to the vertical. In the preferred embodiment, the hanger is of one-piece construction and the lower portion of the stem and the posts are of grid work construction. In this regard, the ankle support sections 15 are formed with respective parallel, laterally spaced apart rails 21 and 23 and the foot support sections 17 formed with the respective rails 19 projecting prependicular to the direction of the rails 23 to angle upwardly and inwardly at an angle of 45° for supporting the inner sole of a booty and the respective rails 31 spaced therefrom at the bottom and converging toward one another in triangular fashions to merge at the upper extremities.

Figure 3:
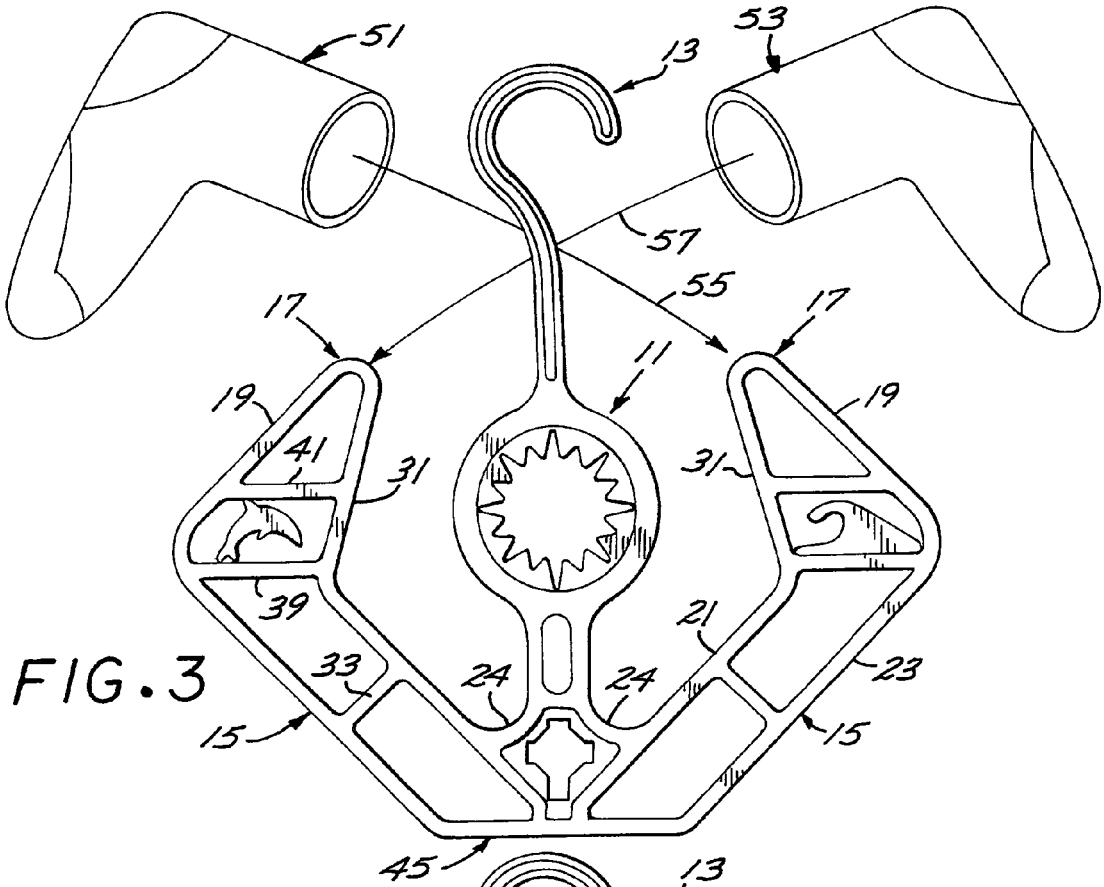
FIG. 3 is a front view of the hanger shown in FIG. 1 with booties in position to be installed.
Figure 4:
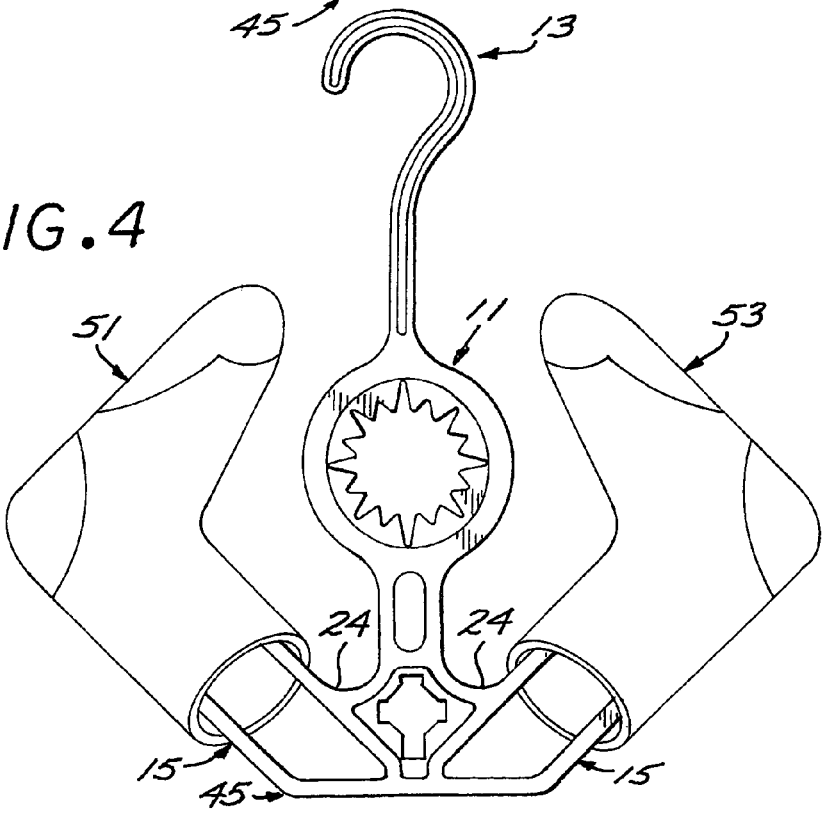
FIG. 4 is a front view similar to FIG. 3 but with the booties installed.

The bodies of the respective rails 21 and 23 and 19 and 31, as seen in FIG. 3. The rails are connected together along their lengths by means of cross ribs defining struts 33, 39 and 41, to cooperate in forming a wide, lightweight sturdy construction to provide support for wet boots and orient them as shown in FIG. 4, the space between the struts and rails forming openings which facilitate circulation of air within a booty.

In the preferred embodiment, the posts are formed at the base of the hanger with a horizontal rail 45 having a downwardly facing support surface which might stand on the top of the post or the like such that the hanger device might be supported on the post rather than being hung from the hook 13.

In operation, when it is desirable to dry a pair of, for instance, surfer's booties, generally designated 51 and 53 (FIG. 3), the booties may be mounted over the respective posts as shown by the respective directional arrows 55 and 57. The booties 51 and 53 are nested down over the respective posts as shown in FIG. 4 with the ankle portions of the booties slid over the foot post section 17 and down over the ankle post sections 15, the foot portions of the booties being guided onto the post foot sections 17 such that the rail 19 engages the insole of the foot sections and serves to support such foot sections angled upwardly and inwardly at about 45° to the vertical, with the toes fully elevated and in such an orientation that any water in the boots tends to drain downwardly to the open top of the respective boots. It will be appreciated that with the wide spaced rail construction for the post 15, as complimented by the cross-struts, the posts provide wide lateral support along the front and back walls of the ankles of the boots 51 and 53 tending to maintain the flexible walls thereof distended forwardly and rearwardly to resist rotation of the boots about the respective longitudinal axes to maintain the boot orientation on the posts. This, coupled with the width at the heel area at the lower bases of the respective triangular foot sections 17, serves to afford a wide expanse within the flexible wall boots for ready circulation of air, while affording positive support and tending to maintain the ankle and foot sections of the boots oriented perpendicular to one another as shown in FIG. 4, for positive air circulation.

As will be apparent to those skilled in the art the scale of the hanger may be changed without detracting from the invention. That is for larger boots, the scale may be increased to maintain the desired orientation of the boot as dictated by the approximate 90° orientation between the ankle and foot support sections.

Additionally, it would be appreciated that the configuration of the posts assists in holding the boots in the orientation shown and further, that the crotch 24 formed at the junction between the opposite sides of the stem and the respective posts will serve to, in the event of an oversized booty or long ankle booty, to engage the top edge of the respective and restrict downwardly sliding to prevent the ankle portion of the booty from assuming a horizontal orientation such that water might collect in a horizontal extent thereof.

From the foregoing, that the hanger device of the present invention provides an economical and convenient means for positively orienting the booty in a self-draining orientation and which has a grid work that provides lightweight relatively compact structure which affords high integrity rigidity for supporting the weight of the wet booties.

We claim:

1. A wet suit booty hanger for hanging a pair of wet suit booties, each booty having an ankle section with front and back walls and a foot section extendable perpendicular to the axis of the ankle section, the hanger comprising:

an upstanding stem formed at its upper extremity with a hook;

a grid work carried from the bottom of the stem and configured with a pair of booty posts projecting upwardly directly from the opposite sides of the stem and cooperating therewith to form respective upwardly opening, U-shaped crotches and including respective elongated ankle post sections projecting upwardly and outwardly at 45° to the vertical and respective foot post sections having respective axes angling upwardly and inwardly perpendicular to the axes of the respective ankle sections, the ankle post sections being constructed of parallel front and back ankle rails spaced laterally apart a distance sufficient to, when the respective booties are mounted thereon, project longitudinally along the respective front and back walls of the ankle sections of the respective booties to maintain the ankle sections of the respective booties distended, the booty foot sections being constructed of respective rails spaced laterally apart and projected upwardly and inwardly from the respective front and back ankle rails and converging together in respective triangular shapes for supporting the respective foot sections of the respective booties, the respective ankle and foot sections including laterally projecting cross ribs spaced longitudinally apart and cooperating with the respective rails to form ventilation openings whereby the respective booties may be fitted over the respective foot posts and the ankle portions thereof, slid down over the respective ankle posts portions to cause the ankle rails to maintain the front and back walls spaced apart and the foot portions of the booties oriented substantially perpendicuiar to the ankle portions of the respective booties to induce moisture from the booties to drain efficiently down and out of the respective booties with the openings between the rails and ribs free for air to circulate there through to induce drying.

2. The wet suit booty hanger of claim 1 wherein:

the grid work is formed on the bottom with a downwardly facing support surface for nesting on top of a post or the like.

3. The hanger apparatus of claim 1 wherein:

the stem is formed with a circular ring interposed between the posts.

4. The hanger apparatus of claim 1 wherein:

the stem and posts are one-piece construction.

5. The hanger apparatus of claim 1 wherein:

the stem and grid work are formed with integral construction.

* * * * *